United States Patent [19]

Bürkhardt

[11] 4,020,758

[45] May 3, 1977

[54] TYPE CARRIER ARRANGEMENT FOR ROLLER PRINTING

[75] Inventor: Gottfried Bürkhardt, Winkelhaid, Germany

[73] Assignee: Diehl datensysteme G.m.b.H, Nurnberg, Germany

[22] Filed: Feb. 24, 1975

[21] Appl. No.: 552,040

[30] Foreign Application Priority Data

Feb. 25, 1974 Germany ..... 2408927

[52] U.S. Cl. ..... 101/110; 101/77; 197/18; 197/55

[51] Int. Cl.[2] ..... B41J 1/34

[58] Field of Search ..... 101/86, 77, 212, 297, 101/109, 110, 91, 92, 95, 99, 93.11; 197/18, 52, 55

[56] References Cited

UNITED STATES PATENTS

| | | | |
|---|---|---|---|
| 987,372 | 3/1911 | Johnston | 101/86 |
| 3,141,402 | 7/1964 | Howard | 101/110 X |
| 3,229,625 | 1/1966 | Pannier | 101/92 |
| 3,237,556 | 3/1966 | Huffman | 101/77 |
| 3,363,550 | 1/1968 | Kruger | 101/110 X |
| 3,605,977 | 9/1971 | Janz et al. | 197/55 X |
| 3,772,939 | 11/1973 | Burkhardt et al. | 101/110 |

*Primary Examiner*—Ralph T. Rader
*Attorney, Agent, or Firm*—Walter Becker

[57] ABSTRACT

A type carrier arrangement for producing a roller print, which includes a continuously rotating type drum having arranged thereon a plurality of type carriers respectively carrying one type. Each type carrier has one gear segment arranged thereon for producing a rolling print. This print is brought about by a control member in cooperation with a gear segment associated with the printing area and not rotating with the type drum. The gear segment of the type drum includes a guiding section formed by the omission of a tooth. After the gear segment has meshed with the tooth segment designed as inner tooth segment, the guiding section is held by fixing means in the starting position thereof. The control means is designed as pawl controlled to act upon a ratchet tooth on the type carrier shaft so that the gear segment is turned in the direction toward the inner tooth segment. Each type shaft comprises in one cross-sectional plane at least two types offset relative to each other at an angle. The types are adapted by stationary pawls arranged in conformity with the type-offset selectively to be caused to print. The tooth spaces of the inner tooth segments correspond to the total of the number of teeth of the gear segment and the number of teeth of the maximum type-offset.

4 Claims, 4 Drawing Figures

TYPE CARRIER ARRANGEMENT FOR ROLLER PRINTING

The present invention relates to a type carrier arrangement for producing a roller print. A printer has become known in which each type shaft arranged in a rotatable type drum has only one type. This type can be caused to print by means of a stationarily arranged pawl through the intervention of a ratchet tooth arranged on the type shaft. To this end a gear segment arranged on the type shaft meshes with a stationarily arranged inner gear segment. This arrangement, however, is not satisfactory for high printing outputs.

According to another heretofore made suggestion, each type shaft carries a plurality of types. Pawls, control teeth, gear segments and inner teeth segments arranged in guiding rings are provided in conformity with the number of types per type shaft. The teeth on the type shaft and the inner teeth segments are relatively expensive inasmuch as each type must have associated therewith a separate gear segment and an inner teeth segment.

It is, therefore, an object of the present invention with printers in which each type shaft carries a plurality of types, to provide simplified teeth systems.

It is another object of this invention to provide an arrangement as set forth in the preceding paragraph according to which by simple means a type shaft controlled by a pawl for printing purposes will after the printing be held in a definite starting position while the type shaft can be controlled from at least two different selective positions.

These and other objects and advantages of the invention will appear more clearly from the following specification in connection with the accompanying drawing, in which.

The type carrier arrangement according to the present invention is characterized primarily in that each type shaft comprises in one cross sectional plane at least two types which are offset relative to each other at an angle and which by means of stationary pawls arranged corresponding to the offset of the types are adapted selectively to be caused to print. The tooth spaces of the inner teeth segment correspond to the total of the number of teeth of the gear segment and the number of teeth of the maximum offset of the types.

Figure 2:
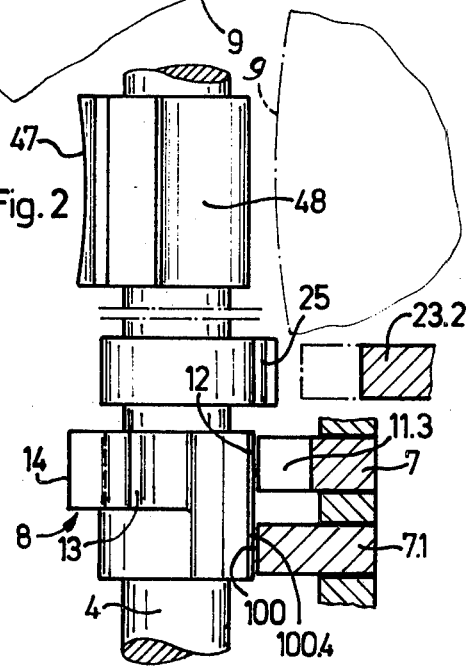
FIG. 2 is a cross section taken along the line II-II of FIG. 1.
Figure 3:
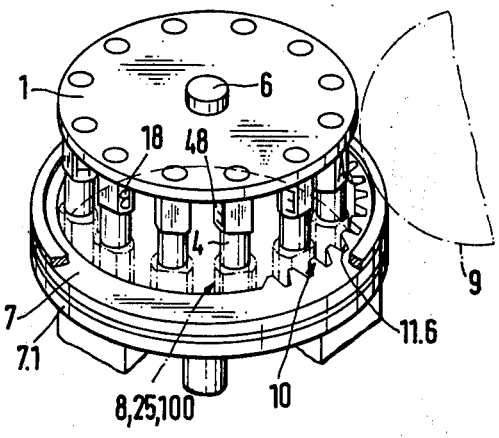
FIG. 3 is a perspective view of features in accordance with the present invention.
Figure 4:
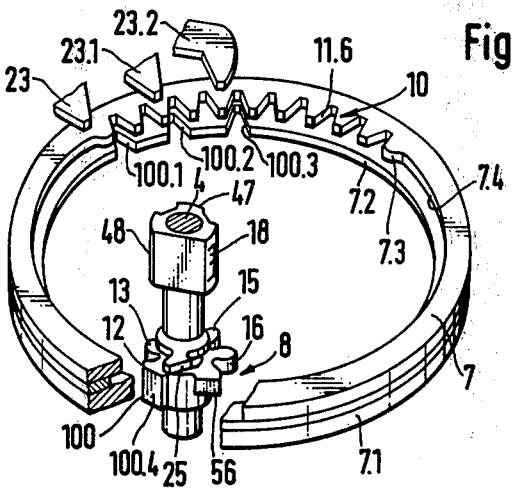
FIG. 4 is a partially sectioned fragmentary perspective view of features in accordance with the present invention.

Referring now to the drawing in detail, a type shaft 4 is rotatably journalled in the type drum 1 which is only partly shown and which is connected to the shaft 6. The type shaft 4 is illustrated only by way of example and can, of course, be replaced by any equivalent type shaft. Provided on said type shaft 4 in a first plane are three types 18, 47, 48, whereas a ratchet tooth 25 is provided on said type shaft 4 in a second plane. Furthermore provided on the type shaft 4 in a third plane is a gear segment 8 with six teeth 12–16, and 56, and in a fourth plane and likewise connected to the type shaft 4 is a cam 100 (FIG. 2) which contourwise corresponds to the tooth 12. In the plane of the ratchet tooth 25 there are pivotally arranged on the dish 7 three pawls 23-14 23.2 which are indicated only partially.

Figure 1:
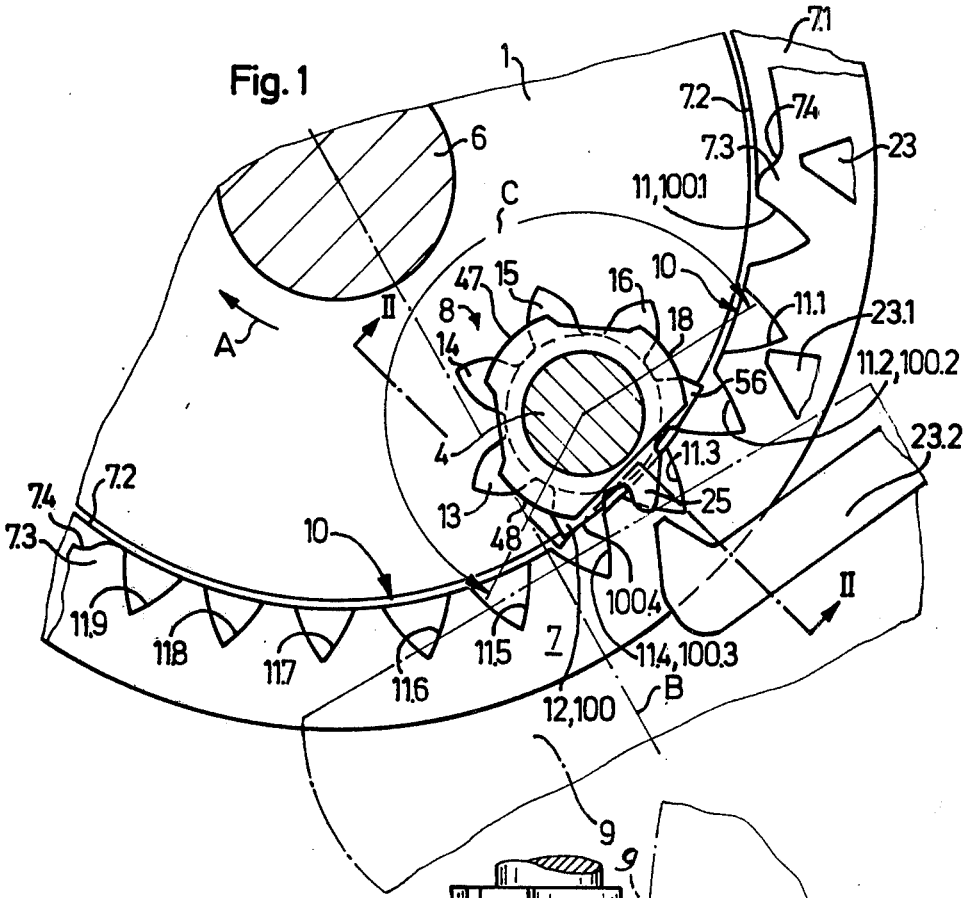
FIG. 1 shows a rolling printer according to the invention which is illustrated in a simplified form.

In the plane of the gear segment 8, the dish 7 comprises ten tooth spaces 11–11.9 and through connecting means which may be of any standard type is connected to a blocking ring 7.1 which is located in the plane of the cam 100 and comprises three recesses 100.1–100.3 located in a blocking surface 7.2 (FIG. 1). The recesses 1001.–100.3 are contourwise corresponding (deckungsgleich) to the tooth spaces 11, 11.2 and 11.4.

The ten tooth spaces 11–11.9 are composed of the number of the six teeth of the gear segment 8 and of the four teeth 13–16 enclosed by the maximum type offset C.

The cam 100 comprises a slightly curved abutment surface 100.4 while the radius of curvature corresponds approximately to the radius of the type drum 1.

The inner teeth segment 10 is located in a region of the dish 7 which is designed as a tooth crest 7.3. Following the tooth space 11.9 there is provided a recess 7.4 which assures that only the cam 100 will stop the controlled type shaft 4 but not the tooth 12. If it is intended to cause the type 18 to print on the printing roller 9, the pawl 23 engages the type shaft 4 turned in the direction of the arrow A, in FIG. 1, and the ratchet tooth 25 which turns the gear segment 8 in the direction toward the inner teeth segment 10. The intermeshing of the thus teeth automatically brings about the printing of type 18 in the printing plane B. During this intermeshing of the teeth, the cam 100 engages the recess 100.1 (FIG. 1). Following the last tooth engagement, this cam 100 abuts with its abutment surface 100.4 the blocking surface 7.2 thereby fixing the type shaft 4 in the illustrated basic position.

A corresponding course of movement occurs when the types are controlled by the pawls 23.1, 23.2, which would entail a toolate moving in of the gear segment 8 into the inner teeth segment 10, the cam 100, will secure the type shaft 4 in its starting position. In this connection, the abutment surface 100.4 rests against the blocking surface 7.2. While in these circumstances an incorrect type print may occur inasmuch as for instance the gear segment 8 initiated by the pawl 23 at a delay will not as intended start meshing with the tooth space 11, but only with the tooth space 11.2 and 11.4. However, a blocking of the gear segment 8 cannot occur. In this way the safety of the print will be assured.

Conserving the action by the cam 100, gear segment 8, blocking surface 7.2 and other related structure, operation thereof occurs to cause the imprinting of the types 18, 47, 48 into print. The imprinting of the types 18, 47, 48 on the printing roller 9 occurs as follows:

For imprinting the type 18, the pawl 23 pivots or swings in the direction of an arrow "A" representing rotation of a drum 1. A ratchet tooth 25 of the type shaft 4 strikes against the pawl 23 and rolls off on the pawl 23. Thereby the type shaft 4 becomes turned or rotated in counterclockwise direction so that the tooth 12 of the gear segment 8 as well as the further teeth 13–16, 56 engage in the tooth spaces 11–11.5 of the dish 7. The teeth 16, 56 have type 18 arranged therewith becoming rolled off against the printing roller 9 by way of engagement thereof in the tooth spaces 11.4, 11.5 in the printing plane "B" on the printing roller 9. The cam 100 engages into the recess 100.1 corresponding to the tooth 12 engaging in the tooth space 11.

After the tooth 56 has departed from the tooth space 11.5, the type shaft 4 rotates without tooth engagement because of the existing inertia moment to move further in a counter clockwise direction until the stricker surface 100.4 of the cam strikes approximately against the blocking surface 7.2 with the tooth space 11.7 and thereby the rotation of the type shaft 4 stops. Thereby, the type shaft 4 is also fixed in the illustrated starting position so that with the next rotation the type 18 or one of the types 47, 48 become imprinted during the next rotation.

For imprinting the type 47, the pawl 23.1 pivots or swings in the direction of the drum 1. The ratchet tooth 25 strikes against the pawl 23.1 whereby the type shaft 4 becomes rotated in counter clockwise direction. The tooth 12 and the cam 100 engage simultaneously in the tooth space 11.2 and into the recess 100.2. Thereafter, the teeth 13–16, 56 mesh with the tooth pawls 11.3–11.7 whereby the type 47 becomes rolled off in the printing plane "B" on the printing roller 9. Subsequently the type shaft 4 turns further in a free manner, until the cam 100 strikes against the blocking surface 7.2 approximately at the tooth space 11.9 and the type shaft 4 becomes fixed in the starting position.

The corresponding is true for the imprinting of the type 48. The pawl 23.2 pivots or swings in the direction of the drum 1. The ratchet tooth 25 strikes against the pawl and brings the tooth 12 and the cam 100 into engagement in the tooth space 11.4 and in the recess 100.3. The type 48 becomes rolled off between tooth engagement of the teeth 12 and 13 in the printing plate "B" on the printing roller 9. After the tooth 56 has engaged into tooth space 11.9, the type shaft 4 rotates further without engagement until striking of the cam 100 against the blocking surface 7.2.

Burkhardt, et al. U.S. Pat. No. 3,772,939, issued Nov. 20, 1973 and belonging to the assignee of the present invention, can be considered to disclose a cam element 20 and a leaf spring 21 for a type 18, but the spring 21 because of the high torque or turning moment of the type shaft 4 is not at all suited to fix the type shaft after imprinting. The spring 21 assures only the starting position (see column 3, lines 25–28 and column 4, lines 16–21). The fixing in the starting position can occur only in a positive or form-closing manner by way of the tooth 12 and the surface 40. Thus the cam 20 and spring 21 are not equivalent to the cam 100 and blocking surface 7.2 of the present invention.

Burkhardt et al, U.S. Pat. No. 3,772,939, issued Nov. 20, 1973 and belonging to the assignee of the present invention may show the type shaft 4 with only one type being fixed and this teaching is valid only for one type per type shaft. If in contrast more than one type becomes provided upon one type shaft and correspondingly more tooth spaces are provided than there are teeth provided with tooth segment 8 and relative to the dish 7, so the tooth 12 as seen in direction of rotation of the drum can stop the type shaft 4 only then when the same strikes upon the surface 40. If, however, the tooth segment 8 seen in direction of turning of the drum engages immediately into the first tooth space of the dish 7, so the tooth 12 cannot fix the type shaft because in essence the torque or turning moment of the type shaft cannot be destroyed or eliminated by way of the spring 21. A spring is not suitable for such bending-changing load; accordingly the tooth 12 engages into one of the remaining tooth spaces. Since, however, ther remaining tooth spaces do not correspond to the number of teeth of the tooth segment, the tooth 12 does not strike or engage upon the surface 40 but rather there is involved a different tooth, for example 15 and the teeth 13, 14 still located in the tooth spaces become sheared off. This effect becomes avoided by way of the present invention through the cam 100/blocking surface 7.2/tooth spaces 100.1–100.3.

Thus, in summary, the U.S. Pat. No. 3,772,939-Burkhardt, et al. dated Nov. 20, 1973 discloses a printer with which every type shaft arranged in a rotatable type drum provides only one type. This type can be caused to print through a stationary pawl by way of a shifting tooth arranged on the type shaft in that a gear segment arranged on the type shaft meshes with a stationary-arranged inner gear segment. In comparison thereto, the present invention is an improvement in that fewer type shafts are necessary with the same number of type so that the type drum can provide a very small diameter.

As will be evident from the above, the present invention brings about that each type shaft independently of the number of the types comprises merely one gear segment, and only one stationary inner teeth segment is necessary.

Furthermore, with a disturbance or disorder in the selection control of the pawls, in each instance the starting position of the type shaft will be retained or will be ordinarily obtained.

In addition thereto, the present invention will assure that after the control of the type shaft has been initiated, due to the pawl which when viewed in the direction of rotation of the type drum is the last pawl only one cam serves as abutment for fixing the starting position of the type shaft but not a tooth of the gear segment. In this way an otherwise possible deformation of the tooth which might effect the function of the gear segment will be safely avoided.

In the drawings, it will be noted that the portion of the type shaft 4 carrying the type sections 18, 47 and 48 is recessed on the side facing the printing roll 9 when the type shaft is in idle, or non-printing position and will thus pass by a printing roller when printing is not required and none of pawls 23.1 and 23.2 have been actuated to engage tooth 25.

It will further be understood that only one of the pawls is actuated during movement of the type shaft through the region where the pawls are located.

It is, of course, to be understood that the present invention is by no means limited to the specific showing in the drawing but also comprises any modifications within the scope of the appended claims.

What I claim is:

1. A printing device comprising; in combination a rotary type drum, at least one type carrier rotatable with the drum and rotatable on the drum, multiple circumferentially spaced type sections thereon each adapted in a respective rotated position of one type carrier to carry out a printing operation in one rotated position of the drum, an arcuate stationary gear segment concentric with the drum in a plane spaced axially from the plane of the type sections, a gear connected to said type carrier means in the plane of said gear segment and having one tooth missing, stationary cam means having a cam surface concentric with said drum in a further axial plane and a cam element connected to said type carrier axially aligned with the leading side of the missing tooth space of said gear engaging said cam surface and positively holding said type carrier in a predetermined rotated idle position on the type drum when the type drum is outside the range of said one rotated position, a control tooth connected to the type carrier in axial alignment with the missing tooth space and in a still further axial plane, circumferentially spaced pawls including a pawl for each type section on the type carrier adjacent the path of said control tooth selectively engageable therewith to rotate said type carrier on the type drum to cause the gear connected therewith to mesh with said gear segment and be rotated thereby during rotation of said drum, said stationary cam means having a cam element receiving space therein for each pawl to permit rotation of said gear when the respective pawl is moved into engagement with said control tooth, the number of tooth spaces in said gear segment being equal to what is required to rotate said type carrier to the idle position thereof when the type carrier has rotated the minimum amount on said type drum to present a type section to printing position.

2. A printing device in combination according to claim 1 in which said cam element is a continuation of the tooth of said gear on the leading side of the missing tooth space.

3. A printing device in combination according to claim 1 in which said cam means comprises a blocking ring having an internal surface thereon forming said cam surface and axially aligned with the tops of the teeth of said gear segment, said cam element receiving spaces in said cam means comprising radially inwardly opening notches axially aligned with tooth spaces of said gear segment.

4. A printing device in combination according to claim 1 in which said type carrier has at least two circumferentially spaced type sections thereon, at least two pawls circumferentially spaced in conformity with the spacing of said type sections, and at least two cam element receiving notches in said cam means, said type carrier having recess means on that side which faces outwardly from the drum when the type carrier is in the idle position thereof on the drum.

* * * * *